United States Patent [19]

Siegl et al.

[11] Patent Number: 4,770,727

[45] Date of Patent: Sep. 13, 1988

[54] METAL-CHELATING DIPHENOLAMINE OLIGOMERS FOR CORROSION INHIBITION OF METAL SUBSTRATES

[75] Inventors: Walter O. Siegl, Dearborn; Mohinder S. Chattha, Livonia, both of Mich.

[73] Assignee: Ford Motor Company, Dearborn, Mich.

[21] Appl. No.: 129,814

[22] Filed: Dec. 7, 1987

Related U.S. Application Data

[62] Division of Ser. No. 5,182, Jan. 20, 1987.

[51] Int. Cl.[4] ..... C23C 22/82

[52] U.S. Cl. ..... 148/6.14 R; 148/6.15 R

[58] Field of Search ..... 148/6.14 R, 6.15 R; 106/14, 15

[56] References Cited

U.S. PATENT DOCUMENTS

| | | | |
|---|---|---|---|
| 4,433,015 | 2/1984 | Lindert | 148/6.15 R |
| 4,447,477 | 5/1984 | Deibig et al. | 148/6.15 R |
| 4,466,840 | 8/1984 | Frank et al. | 148/6.14 R |
| 4,714,752 | 12/1987 | Sckalaski | 148/6.14 R |

*Primary Examiner*—Sam Silverberg

*Attorney, Agent, or Firm*—Lorraine S. Melotik; Roger L. May

[57] ABSTRACT

This invention relates to a water-soluble or water-dispersible diphenolamine oligomeric metal-chelating compound, method for making same, aqueous composition comprising the compound useful to deposit a corrosion preventive and adhesion promoting coating on a metal substrate and a method for doing same. The composition has a pH of between about 2 and about 10.

5 Claims, No Drawings

METAL-CHELATING DIPHENOLAMINE OLIGOMERS FOR CORROSION INHIBITION OF METAL SUBSTRATES

This is a division of application Ser. No. 005,182, filed Jan. 20, 1987.

Reference is made to commonly assigned and concurrently filed related U.S. applications Ser. No. 129,813 entitled "Corrosion Inhibiting Aqueous Compositions Comprising Metal-Chelating Diphenolamine Compounds" and Ser. No. 129,815 entitled "Corrosion Inhibiting Aqueous, Acidic Compositions Comprising Metal-Chelating o-Hydroxybenzylamine Compound", both to Siegl et al.

TECHNICAL FIELD

This invention relates to metal-chelating diphenolamine oligomers, an aqueous composition comprising same useful to deposit a corrosion inhibiting and adhesion promoting coating on a metal substrate and a method for doing same.

BACKGROUND OF THE INVENTION

One means of minimizing the impact of corrosion on metal surfaces has been to coat the surface with paint. The paint acts as a barrier between the metal surface and the environment and thus helps to prevent or at least minimize corrosion of the metal surface. However, one problem associated with this solution is that paint does not always adhere properly to the metal surface. The result may be peeling, cracking, blistering, or flaking of the paint, thus rendering the substrate metal surface again subject to corrosion.

The need for applying protective coatings to metal surfaces for improved corrosion resistance and paint adhesion is well known in the metal finishing and other metal arts. One attempt to alleviate the problem of poor adhesion of paint to metal surfaces has been to subject the metal substrate to a treatment which is known as phosphating, i.e. a process by which the metal surfaces are treated with chemicals which form a metal phosphate conversion coating on the metal surface. Such treatment typically assists in rendering the metal surface less subject to corrosive attack and, at the same time, in rendering the surface more suitable for application of paint. The resulting bond between the metal surface and the paint is thus greatly improved. However, phosphate baths require that precise formulations be maintained and that the processing procedures and conditions of operation be controlled within narrow limits. The phosphating process also requires that the metal surface be given two rinses subsequent to the phosphating bath, the first being a water rinse and the second being a passivating solution rinse which further enhances the corrosion resistance and adhesion characteristics of the coating. Traditionally, conversion coated metal surfaces have been given a second rinse with a solution containing a hexavalent chromium compound.

Lindert, in U.S. Pat. No. 4,433,015, teaches that, because of the toxic nature of hexavalent chromium compounds, expensive treatment equipment must be used to remove chromates from water effluent to prevent the pollution of rivers, streams and drinking water sources. Hence, in recent years there have been research and development efforts directed to discovering effective alternatives to the use of such post-treatment solutions. Lindert teaches that an alternative to the hexavalent chromium compound is a polymer having phenol groups attached along an ethylenic polymer backbone. The phenol groups may have a amine substituent which may further comprise hydroxy-alkyl groups. The polymer, made water soluble through neutralization of the amine moiety with organic acid, may be employed in an acidic or basic solution. It is also taught by Lindert that this solution, in addition to being used as a post-phosphate rinse, may be used to treat previously untreated metal surfaces including aluminum and zinc.

Frank et al, in U.S. Pat. No. 4,466,840, teach that there exists a need for a simple means to achieve results similar to that obtained with the phosphating process without the complexity of such a treatment. As an alternative to such phosphating treatment, Frank et al propose employing hydroxybenzylamines, preferably in aqueous solution, to produce coatings on metal surfaces, which coatings act as corrosion inhibitors and adhesion promotors. The amine moiety of these hydroxybenzylamines comprises secondary amine having alkyl substituents.

Deibig et al, in U.S. Pat. No. 4,447,477, teach a method for producing corrosion inhibiting coatings on metallic surfaces, whereby monomeric phenols and low molecular weight condensation products of formaldehyde and ammonia or amines are applied onto the pretreated surface and cured under heat.

None of the above references teach the diphenolamine oligomeric compound of the present invention, which compound is adapted to chelate metal ions to form a corrosion inhibiting coating on metal substrates.

DISCLOSURE OF THE INVENTION

The present invention is directed to a water-soluble or water-dispersible diphenolamine oligomeric compound selected from compounds having the general chemical formula:

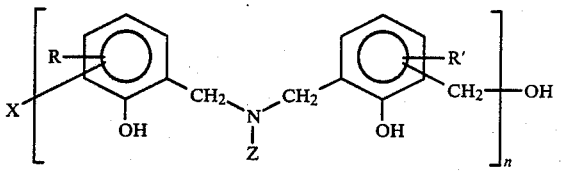

wherein each R and R' is independently selected from alkyl, alkoxy, aryl and halogen, X is hydrogen, $CH_2OH$ or a covalent bond to a methylene bridging group, Z is alkyl, aryl or hydroxy alkyl, more preferably having a hydroxyl 2 or 3 carbons removed from the nitrogen, and n is between about 2 and about 150, more preferably n is between about 3 and about 5. X and R are each attached at the ortho or para position on its phenol ring and R' and the methylene bridging group are each attached at the ortho or para position on its phenol ring. Preferably, both R and R' are each attached to its phenol ring at the para position, and Z preferably is ethanol or propanol moiety. Preferably the compound has a molecular weight between about 700 and about 50,000.

The present invention is also directed to diphenolamine oligomeric compounds which are the reaction product of reactants comprising: (A) formaldehyde and (B) diphenolamine in about a 1–2:1 molar ratio. The diphenolamine is the reaction product of (i) phenol which is unsubstituted at at least one ortho position and one, but not both, of (a) the other ortho position or (b)

the para position is substituted by an alkyl, alkoxy, aryl or halogen and the other of these two positions (i.e., a or b) is unsubstituted, (ii) primary amine, preferably having a hydroxyl group 2 or 3 carbons removed from the nitrogen on a pendant alkyl or substituted alkyl group, and (iii) formaldehyde. The phenol (i), primary amine (ii) and formaldehyde (iii) are reacted in about a 2:1:2 molar ratio in forming the diphenylamine.

The present invention is also directed to an aqueous composition comprising this diphenolamine oligomeric compound useful to deposit a corrosion inhibiting and adhesion promoting coating on a corrodible metal substrate. The composition has a pH between about 2 and about 10 and comprises at least about 0.01 weight percent, preferably between about 0.1 and about 5 weight percent of the oligomeric compound. Preferably, the pH of the composition is between about 2 and about 10. For use on bare metal, the composition preferably has a pH of about 2–4, while for use on phosphated metal, the composition preferably has a pH of about 5–10.

This invention is also directed to a method for depositing an adhesion promoting and corrosion inhibiting coating on a corrodible metal substrate, which method comprises contacting the substrate with the above described composition for a time sufficient to deposit a coating comprising water-insoluble diphenolamine oligomeric metal-chelate compound thereon.

In an acidic solution, metal ions are liberated from the surface of a metal substrate. When a metal substrate is contacted with an aqueous, acidic composition of the present invention, metal ions, e.g. $Fe^{+3}$, are liberated from the substrate surface and form a complex with the diphenolamine oligomeric metal-chelating compound present in the composition. It is believed that the compound's ability to chelate metal ions is based on the fact that the hydroxyl group on the phenol is ortho in position to the amine moiety. In particular, the pendant hydroxyl group and the nitrogen in this defined arrangement chelate with the metal ion. While the metal-chelating compound is water-soluble or water-dispersible, the metal-chelate compound formed is, on the other hand, insoluble in the aqueous, acidic composition and precipitates onto the substrate to form a coating. Similarly, in treating a phosphated metal substrate with a slightly acidic or basic composition of this invention, $Fe^{+3}$ or $Zn^{+2}$ in the phosphate is liberated and complexes with the oligomeric metal-chelating compound to form a precipate which coats the metal substrate. While the above theory is advanced to explain the ability of the metal-chelating compound of the composition to form a coating, neither its accuracy nor its understanding is necessary for operation of the present invention.

Advantageously, the present invention composition provides a simple method for depositing a coating on a metal substrate for inhibiting corrosion of the metal substrate and for improving adhesion of paint thereto. Advantageously, the adhesion promoting ability of the present invention coating is also effective when employed with organic adhesives.

DETAILED DESCRIPTION OF THE INVENTION

The water-soluble or water-dispersible metal-chelating diphenolamine oligomeric compound of the present invention is selected from diphenolamine oligomeric compounds having the general chemical formula:

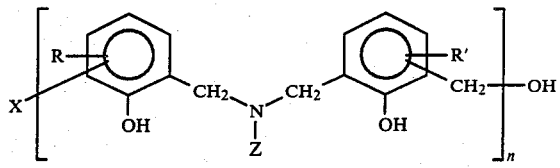

wherein each R and R' is independently selected from alkyl, alkoxy, aryl and halogen, X is hydrogen, $CH_2OH$ or a covalent bond to a methylene bridging group, Z is alkyl, aryl or hydroy alkyl, more preferably having a hydroxyl 2 or 3 carbons removed from the nitrogen, and n is between about 2 and about 150, more preferably n is between about 3 and about 5. X and R are each attached at the ortho or para position on its phenol ring and R' and the methylene bridging group are each attached at the ortho or para position on its phenol ring. Preferably, both R and R' are each attached to its phenol ring at the para position so that the methylene bridging between the diphenolamine units of the oligomer takes place at the ortho positions of the phenol rings of the diphenolamine units. The meta positions on the phenol rings and substituent Z may optionally be substituted with non-interfering functionality, i.e., functionality that will not substantially interfere with the intended use of these compounds according to the described present invention. Exemplary non-interfering functionality which may be so substituted includes alkyl, alkoxy, aryl and halogen. Preferably, the meta positions on the phenol rings and substituent Z are unsubstituted or substituted with alkyl or aryl and more preferably, when substituted, are substituted with alkyl of 1 to 4 carbons. Substituent Z most preferably is ethanol, propanol, substituted ethanol or substituted propanol moiety. The diphenolamine units of the oligomeric compound may be similar or different as may be the substituents and their attachment positions on each phenol ring of the diphenolamine units. Preferably, the compound has a molecular weight between about 700 and about 50,000. As will be apparent to those in the art in view of the present disclosure, the alkyl and alkoxy groups mentioned above may be of carbon chain lengths which allow the diphenolamine oligomeric compound to be water-soluble or water-dispersible, if necessary, with the aid or acid or base.

This diphenolamine oligomeric compound may be made by first forming a diphenolamine and subsequently reacting the diphenolamine with formaldehyde. According to one method for making the oligomeric compound of the present invention, phenol, primary amine, and formaldehyde (in about a 2:1:2 molar ratio) are reacted to form a diphenolamine, which diphenolamine is subsequently reacted with formaldehyde in chain extension in about a 1:1–2 molar ratio. As will be apparent to one skilled in the art in view of the present disclosure, mixtures of phenols as well as mixtures of primary amines may be employed as the phenol and primary amine in making the diphenolamine. Such diphenolamines may be made by techniques described, e.g., in U.S. Pat. Nos. 2,802,810, 2,870,134, 2,957,908, 3,219,700, 3,219,701 and 3,183,093, which patents are hereby expressly incorporated by reference for such teachings of techniques for preparation of diphenolamines. In forming the oligomeric compound, as described above, the diphenolamine may be isolated from the reaction mixture in which it was made prior to being reacted with formaldehyde to form the oligomeric compound. Alternately, the diphenolamine may be left in the reaction mixture in which it was made and formaldehyde added thereto to form the oligomeric compound, i.e., formed "in situ".

The phenol used to form the oligomeric compound of this invention can be any phenol or substituted phenol, such that the phenol has at least one unsubstituted ortho position and one, but not both, of (a) the other ortho position or (b) the para position is substituted by an alkyl, alkoxy, aryl or halogen and the other of these two positions is unsubstituted. Preferably, the phenol has two unsubstituted ortho positions. The phenol component used to form the oligomeric compound of this invention may be one phenol or a mixture of compatible phenols. The primary amine can be any primary amine containing pendant alkyl, aryl, or hydroxy alkyl, preferably containing a pendant hydroxyalkyl group which has a hydroxyl group 2 or 3 carbons removed from the nitrogen, e.g., glucosamine. The primary amine component may also comprise a mixture of compatible primary amines. The meta positions on the phenol and the pendant group (e.g., the alkyl ) on the primary amine may be unsubstituted or substituted with non-interfering functionality, i.e., functionality which does not substantially interfere with the intended reaction of the phenol, amine and formaldehyde to form the diphenolamine or oligomeric compound therefrom, as described herein, or the intended use of the oligomeric compound of this invention as described herein. Exemplary non-interfering functionality which may be so substituted includes alkyl, alkoxy, aryl and halogen. PreferablY, the meta positions on the phenol and the pendant group on the primary amine are unsubstituted or substituted with alkyl or aryl and more preferably, when substituted, are substituted with alkyl of 1 to 4 carbons. Substituent Z preferably is ethanol or propanol moiety. Since the diphenolamine may be made from mixtures of phenols, mixtures of primary amines and formaldehyde, as described above, the phenol rings of the repeating diphenolamine unit of the oligomeric compound of this invention need not be similar. Additionally, as would be apparent to one skilled in the art in view of the present disclosure, since the oligomeric compound may be made from mixtures of diphenolamines, the diphenolamine units of the oligomeric compound need not be similar. The phenol, primary amine, and formaldehyde may be reacted in a two step process or in situ, as described above, according to techniques known to those skilled in the art in view of the present disclosure. In view of the present disclosure, other methods of making the diphenolamine oligomeric compound of this invention will be apparent to one skilled in the art.

The composition of the present invention comprises at least about 0.01 weight percent of the above described water-soluble or water-dispersible metal-chelating diphenolamine oligomeric compound. Preferably, the composition comprises this compound in an amount between about 0.1 and about 5 weight percent. While amounts greater than this preferred amount may be employed in the composition, it does not appear that the corrosion protection provided by the resultant coating is further substantially enhanced. Thus, it does not appear commercially advantageous to employ such greater amounts. However, under some circumstances, for example for transporting or storing the solution, the concentrate of the composition may be preferred. Thus, compositions generally comprising up to about 30 percent of the treatment compound may be provided. From a commercial point of view, a suitable concentrate of this invention comprises from about 5 percent to about 30 percent of the treatment compound.

The treatment composition of the present invention is an aqueous solution preferably having a pH between about 2 and about 10. As stated above, when the composition is employed to treat bare metal (i.e., non-phosphated metal) the pH of the composition is preferably between about 2 and 4, more preferably between about 2.5 and 3.5. When the composition is employed to treat phosphated metal, the composition preferably has a pH between about 5 and 10. Organic and inorganic acids may be employed to provide the desired acidic character (pH) to the composition. Preferably, acids so employed are acids of strongly coordinating anions such as phosphoric acid, sulfuric acid, hydrochloric acid, oxalic acid and acetic acid, acids of weakly coordinating ions, e.g., $ClO^{-4}$ being less effective. Mixtures of compatible acids may also be employed to provide an acidic pH to the aqueous composition. Bases such as sodium hydroxide, potassium hydroxide and ammonium hydroxide, and compatible mixtures of any of such bases, may be employed to provide the desired basic character (pH) to the composition. Various other bases which may be employed in this invention will be apparent to those skilled in the art in view of the present disclosure.

Optional materials which may be included in the composition of this invention include those materials commonly employed in corrosion inhibiting coating and adhesion promoting formulations. Exemplary of such materials are dispersing agents, pigments, adhesion promoters and solubilizers such as polyacrylic acids, polyamines, and polyphenols (e.g., novolaks). The aqueous composition of this invention may also comprise an alcohol as a cosolvent (i.e. in addition to the water), which alcohol has been found useful to produce a clear solution. Exemplary alcohols which may be so employed include, but are not limited to, methanol, ethanol, isopropanol, and propasol-p (trademark, Union Carbide Corp.).

As in a typical metal treatment operation, the metal to be treated with the aqueous composition of the present invention is initially cleaned by a chemical and/or physical process and water rinsed to remove grease and dirt from the surface. The metal surface is then brought into contact with the treatment solution of this invention. The present invention is useful to coat a broad range of metal surfaces, including zinc, iron, aluminum, tin, copper and their alloys, including cold-rolled, ground, pickled, and hot rolled steel. The metal surface may be in any physical form, such as sheets, tubes, or rolls.

The corrosion inhibitor, adhesion promotor composition of the present invention may be applied to metal surfaces in any convenient manner. Thus, it may be sprayed, painted, dipped or otherwise applied to the metal surface. The temperature of the applied solution can vary over a wide range, from the solidification temperature of the solution or dispersion to the boiling point of the solution or dispersion. During application to the metal surface, the temperature of the composition of this invention is preferably between about 20° C. and 80° C., more preferably between about 20° C. and 55° C. It is generally believed that a substantially uniform layer of the corrosion inhibitor/adhesion promoter coating should be deposited on the metal surface. It is also believed that something approaching a molecular layer is sufficient to achieve the desired results. Useful contact time has been found to be about 0.25 to about 5 minutes with contact times between about 0.25 and 1 minute being sufficient at about room temperature. It will be apparent to those skilled in the art in view of the present disclosure, that treatment time and temperature of the applied composition may vary from those described. Selection of optimal composition and method parameters, such as concentration of the metal-chelating compound, pH, inclusion of optional materials, contact time, and bath temperature during coating, will depend, in part, on the particular substrate, processing conditions and final coating desired. As such, selection of such parameters will be within the skill of those in the art in view of the present disclosure.

After application of the treatment solution to the metal surface, the surface is preferably rinsed when such surface is a non-phosphated metal surface. Such rinsing is optional for a phosphated metal surface. Although, in either case, good results can be obtained without rinsing after treatment. For some end uses, for example, in electrocoat paint application, rinsing may be preferred with either type of substrate. Next, the treated metal surface is dried. Drying can be carried out by, for example, circulating air or oven drying. While room temperature drying can be employed, it is preferable to use elevated temperatures to decrease the amount of drying time required. After drying, the treated metal surface is ready for painting or the like. The surface is suitable for standard paint or other coating application techniques such as brush painting, spray painting, electro-static coating, dipping, roller coating, as well as electrocoating. As a result of the treatment step of the present invention, the metal chelate compound coated surface has improved paint adhesion and corrosion resistance characteristics. Additionally, this coated surface acts to improve the adhesion when conventional adhesive materials are used to affix one such coated surface to another.

The invention will be further understood by referring to the following detailed examples. It should be understood that the specific examples are presented by way of illustration and not by way of limitation. Unless otherwise specified, all references to "parts" are intended to mean parts by weight.

EXAMPLE 1

To 0.2 moles of 4-methylphenol and 0.1 moles of ethanolamine dissolved in 50 ml of ethanol was added 15 ml of 37% formaldehyde solution (about 0.2 moles). The mixture was stirred for 20 hours at 40° C. An additional 15 ml of 37% formaldehyde was added to the clear reaction mixture, and the pH was adjusted to 10.3 by the addition of sodium hydroxide. The mixture was stirred and heated at reflux for 5 hours, then allowed to cool to room temperature. The solvent was removed under vacuum to yield a sticky yellow oil. The oil was washed with water and then dried again.

Gel permeation chromatography of the oil, using the diphenolamine obtained from 4-methylphenol, ethanolamine, and formaldehyde as a reference standard, indicated that it contained a distribution of molecular weight with the trimer (n=3)predominating. The infrared spectrum exhibited bonds characteristic of an o-hydroxybenzylamine structure: 1482, 1255, and 1235 $cm^{-1}$. A sample of the oil product made above was reacted with $FeCl_3$ in mildly acidic solution to form a water-insoluble precipitate.

0.5 g of the oligomer (oil) made above was dissolved in 500 ml of a water/ethanol mixture (3:2 by volume) to form a 0.1% by weight clear solution. The pH was adjusted to 3 with phosphoric acid. Cold-rolled steel panels were degreased by rinsing with toluene and with acetone and were then dipped in this solution, rinsed with deionized water, allowed to drain, and then dried for 10 minutes at 110° C. before being spray painted with a tall oil modified bisphenol A-epichlorohydrin epoxy resin/crosslinked with alkylated melamine primer and cured for 20 minutes at 150° C. The cured paint thickness was between 28–33 μm. Panels were scribed and tested by the standard salt spray method (ASTM B-117). While the painted panels treated with this solution did not fail until after 8 days of salt spray testing, untreated painted panels failed after only 3–4 days of salt spray testing. (Failure is considered 4mm of paint loss (undercutting) on either side of the scribe line.) In this and the following examples, untreated panels are similarly painted panels prepared as in the example except that deionized water was used in place of the treatment solution comprising diphenolamine oligomeric compound.

EXAMPLE 2

A solution was prepared containing 0.50 g of oligomer, prepared as described in Example 1, in a mixture of 200 ml ethanol and 300 ml water. The pH of the solution was about 9. Iron phosphated steel panels (Bonderite 1000, trademark, Parker Chemical Co.) were dipped in the solution for 1 minute at ambient temperature, rinsed with deionized water and then dried in a 180° C. oven for 5 minutes. After cooling to room temperature, the panels were sprayed with the primer described in Example 1 and cured for 20 minutes at 150° C. In salt spray testing (ASTM B-117), painted panels treated in this did not fail until after 15 days of salt spray testing.

EXAMPLE 3

0.1 % (by weight) solution of an oligomer, prepared as described in Example 1, in an ethanol/water mixture (1:2 by volume) was prepared and heated to 120° F. (The natural pH of the solution was about 8.) Iron phosphated steel test panels (Bonderite 1000, trademark, Parker Chemical Co., Detroit, Mich.) were dipped in the solution for approximately 30 seconds, rinsed with deionized water, and dried at 350° F. for 3 minutes. The panels were then spray painted with Duracron 200 (trademark, PPG Industries) paint and cured for 20 minutes at 150° C. The cured paint thickness of the paint was about 28–33 μm. The painted panels were then scribed and exposed to salt spray testing (ASTM B-117). After 21 days of salt spray testing, painted panels so treated showed 3mm of paint of paint loss away from the scribe line, whereas untreated painted panels showed 11–13 mm of paint loss.

EXAMPLE 4

Iron phosphated steel panels (Bonderite 1000, trademark, Parker Chemical Co.) were treated, dried, painted, cured and scribed as described in Example 3 except that the deionized water rinse was eliminated. In salt spray testing (ASTM B-117), painted panels treated in this manner showed 2 mm of paint loss (undercutting) whereas untreated painted panels showed 11–13 mm of paint loss.

EXAMPLE 5

Iron phosphated steel panels (Bonderite 1000, trademark, Parker Chemical Co.) were treated, rinsed, dried, painted and cured as described in Example 4 except that the pH of the treatment was adjusted to 6.2 with phosphoric acid. The panels were scribed and subjected to salt spray testing. After 21 days of salt spray testing, the painted treated panels showed 5 mm of paint loss (undercutting), whereas painted untreated painted panels showed 11–13 mm of paint loss.

EXAMPLE 6

A diphenolamine oligomer compound of the present invention composition is prepared according to the procedure of Example 1, except that 0.1 moles of 3-aminopropanol are used in place of the ethanolamine. A 0.1% (by weight) solution of this oligomer is prepared.

Cold rolled steel panels are toluene/acetone rinsed, dipped in the solution of this example and rinsed according to the procedure of Example 1. The panels were spray painted, cured, scribed and subjected to salt spray testing (ASTM B-117) as in Example 1. The painted panels treated in this manner exhibit improved corrosion protection relative to untreated painted panels.

EXAMPLE 7

A diphenolamine oligomer compound of the present invention composition is prepared according to the procedure of Example 1, except that 0.2 moles of 4-ethylphenol are used in place of 4-methylphenol. A 0.1% (by weight) solution of this oligomer is prepared as described in Example 1.

Cold rolled steel panels are toluene/acetone rinsed, dipped in the solution of this example and rinsed according to the procedure of Example 1. The panels are spray painted, cured, scribed and subjected to salt spray testing (ASTM B-117) as in Example 1. The painted panels treated in this manner exhibit improved corrosion protection relative to untreated painted panels.

EXAMPLE 8

A solution is prepared as described in Example 1, except that sulfuric acid is used in place of phosphoric acid to adjust the pH.

Cold rolled steel panels are toluene/acetone rinsed, dipped in the solution of this example and rinsed according to the procedure of Example 1. The panels were spray painted, cured, scribed and subjected to salt spray testing (ASTM B-117) as in Example 1. The painted panels treated in this manner exhibit improved corrosion protection relative to untreated painted panels.

EXAMPLE 9

A solution is prepared as described in Example 1. Cold rolled steel panels are toluene/acetone rinsed, dipped in the solution of this example and rinsed according to the procedure of Example 1 except that a dip time of 0.25 minutes is used in place of 1 minute. The panels are spray painted, cured, scribed and subjected to salt spray testing (ASTM B-117) as in Example 1. The painted panels treated in this manner exhibit improved corrosion protection relative to untreated painted panels.

EXAMPLE 10

With the temperature maintained below 25° C., 0.10 mole of 37% aqueous formaldehyde solution was added slowly to a mixture of 0.10 mole of 4-methylphenol and 0.050 mole of ethanolamine in 50 ml of ethanol. After stirring for 1 hour at room temperature, the mixture was stirred for 40 hours at 40°±5° C. The solvent was removed under reduced pressure to leave a pale yellow oil. The oil was taken up in toluene; on standing, white crystals deposited. The crystals were collected, washed with toluene and cyclohexane, and dried. Additional crops of diphenolamine were obtained upon addition of heptane to the filtrate. The isolated yield was 22%; no attempt was made to recover the remaining diphenolamine from the filtrate. Recrystallization from toluene afforded an analytical sample, mp 153.5°–54.5° C.; ir(KBr): 1610(w), 1512(sh), 1505(vs), 1272(m), 1260(m), 1245(m) $cm^{-1}$. Elem. Anal.: Calcd for $C_{18}H_{23}NO_3$; C, 71.73; H, 7.69; N, 4.65. Found: C, 72.09; H, 7.54; N, 4.66.

A 0.01 mole sample of the diphenolamine prepared above in Example 10 is dissolved in ethanol-water (1:1 by volume) and the pH is adjusted to about 10 by the addition of NaOH. The solution is stirred and 0.01 mole of 37% aqueous formaldehyde solution is added. After stirring 30 minutes at ambient temperature, the solution is heated at reflux for 12 hours. The solvent is removed under reduced pressure to yield a viscous yellow oil which solidifies on standing. The resulting oligomer is washed several times with water. Gel permeation chromatography indicates that this diphenolamine oligomeric compound is of higher molecular weight than the one prepared in Example 1.

0.5 g of the solid product oligomeric compound prepared above is dissolved in 500ml of an ethanol/water mixture (2:3 by volume). Cold rolled steel panels were toluene/acetone rinsed, dipped in the solution of this example and rinsed according to the procedure of Example 1. The panels are spray painted, cured, scribed and subjected to salt spray testing (ASTM B-117) as in Example 1. The painted panels treated with this oligomer perform significantly better in salt spray testing (ASTM B-117) than untreated painted panels.

EXAMPLE 11

A 0.1% solution of the oligomer (prepared as described in Example 10) is made in isopropanol-water. Iron phosphated panels (Bonderite P-1000, trademark, Parker Chemical Co.) are dipped in the solution at 50° C. for 30 seconds, rinsed with deionized water, and dried for 5 minutes at 180° C. The panels are then sprayed with Duracron 200 paint (PPG Industries), cured for 20 minutes at 150° C., scribed and subjected to salt spray testing (ASTM B-117). Painted panels treated with this oligomer perform significantly better in salt spray testing (ASTM B-117) than do untreated painted panels.

EXAMPLE 12

The procedure of Example 11 is repeated except that the deionized water rinse is eliminated. Painted panels treated in this way showed significantly less undercutting from the scribe line after 14 days in salt spray testing (ASTM B-117) than did untreated painted panels.

EXAMPLE 13

A solution is prepared as described in Example 1. Cold-rolled steel coupons (1"×4") are degreased by rinsing with toluene and with acetone and are then dipped in this solution, rinsed with deionized water, allowed to drain, and then dried for 10 minutes at 110° C. The treated coupons are then bonded in a single overlap joint (1" square) using a 2-component epoxy adhesive (Quantum Composites Co.). The bond strength is tested on an Instron Mechanical test apparatus; a greater than 50% increase in bond strength is observed over that observed for untreated coupons. After 2 weeks of humidity exposure, the relative increase in bond strength is even greater.

EXAMPLE 14

The diphenolamine prepared as described in Example 10, is treated with formaldehyde solution as described in Example 10 except that 0.013 mole of formaldehyde is used in place of 0.01 mole formaldehyde. An oligomer mixture of lower molecular weight is obtained.

Cold rolled steel panels are toluene/acetone rinsed, dipped in the solution of this example and rinsed according to the procedure of Example 1. The panels are spray painted, cured, scribed and subjected to salt spray testing (ASTM B-117) as in Example 1. The painted panels treated in this manner exhibit improved corrosion protection relative to untreated painted panels.

EXAMPLE 15

A diphenolamine oligomer of the present invention composition is prepared according to the procedure of Example 1, except that 0.1 moles of 37% formaldehyde solution is added in the second formaldehyde addition instead of 0.2 moles. A 0.1% solution of this oligomer is prepared according to the procedure of Example 2.

Cold rolled steel panels are toluene/acetone rinsed, dipped in the solution of this example and rinsed according to the procedure of Example 1. The panels are spray painted, cured, scribed and subjected to salt spray testing (ASTM B-117) as in Example 1. The painted panels treated in this manner exhibit improved corrosion protection relative to untreated painted panels.

EXAMPLE 16

A diphenolamine oligomer of the present invention composition is prepared according to the procedure of Example 1, except that 7.5 ml (about 0.1 moles) of 37% formaldehyde solution is added in the second formaldehyde addition instead of 15 ml (about 0.2 moles). A 0.1% solution of this oligomer is prepared according to the procedure of Example 1. Iron phosphated steel panels are treated with this solution, rinsed and dried as described in Example 3. After cooling to room temperature, the panels are painted and cured as in Example 2. In salt fog testing (ASTM B-117), the painted panels treated in this manner exhibit improved corrosion protection relative to untreated painted panels.

EXAMPLE 17

To 0.1 moles of ethanolamine dissolved in 50 ml of ethanol, 0.1 moles of 37% formaldehyde solution is added slowly while the temperature is maintained below 25° C. 4-Methylphenol (0.2 moles) is added. After stirring for 4 hours at reflux, the mixture is cooled to room temperature. An additional 0.12 moles of 37% formaldehyde solution is added, and the pH is adjusted to 10 by the addition of sodium hydroxide. The mixture is stirred at reflux for 5 hours, allowed to cool, and the solvent is removed at reduced pressure. The semisolid residue is washed with water.

A 0.1% solution of this oligomer is prepared and applied to acetone/toluene cleaned cold-rolled steel panels as described in Example 1. The panels are rinsed, dried, spray painted, cured and scribed according to the procedure of Example 1. In salt spray testing (ASTM B-117), painted panels treated in this manner exhibit improved corrosion protection relative to untreated painted panels.

EXAMPLE 18

A 0.1% solution of the oligomer described in Example 17 is prepared and applied to iron phosphated steel panels according to the procedure described in Example 2. The panels are spray painted and cured as described in Example 1. In salt spray testing (ASTM B-117), painted panels treated in this manner exhibit improved corrosion protection relative to untreated painted panels.

We claim:

1. A method for inhibiting corrosion of a corrodible metal substrate, said method comprising:

contacting said metal substrate with an aqueous composition (1) having a pH between about 2 and about 10, (2) comprising at least about 0.01 weight percent of water-soluble or water-dispersible diphenolamine oligomeric metal-chelating compound, and (3) for a time sufficient to deposit a corrosion preventative coating comprising water-insoluble diphenolamine oligomeric metal-chelate compound, wherein said diphenolamine oligomeric metal-chelating compound is selected from compounds having the general chemical formula:

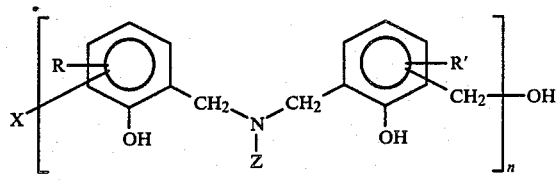

wherein each R and R' is independently selected from alkyl, alkoxy, aryl and halogen, X is hydrogen, $CH_2OH$ or a covalent bond to a methylene bridging group, Z is alkyl, aryl or hydroxy alkyl, X and R are each attached at the ortho or para position on its phenol ring and R' and said methylene bridging group are each attached at the ortho or para position on its phenol ring, and n is between about 2 and about 150.

2. The method according to claim 1 suitable for use on a phosphated metal substrate, wherein said pH of said composition is between about 6.0 and about 10.0.

3. The method according to claim 1 suitable for use on a non-phosphated metal substrate, wherein said pH of said composition is between about 2.5 and about 3.5.

4. The method according to claim 1, wherein said composition comprised between about 0.1 and about 5 weight percent of said diphenolamine oligomeric metal-chelating compound.

5. The method according to claim 1, wherein the temperature of said composition is between about 20° and about 55° C.

* * * * *